US006182398B1

(12) United States Patent
Head

(10) Patent No.: US 6,182,398 B1
(45) Date of Patent: Feb. 6, 2001

(54) CURVED AIR BEAM

(75) Inventor: Andrew A. Head, Indian Hill, OH (US)

(73) Assignee: A&P Technology, Inc., Cincinnati, OH (US)

( * ) Notice: Under 35 U.S.C. 154(b), the term of this patent shall be extended for 0 days.

(21) Appl. No.: 09/196,960

(22) Filed: Nov. 20, 1998

Related U.S. Application Data

(60) Provisional application No. 60/066,381, filed on Nov. 21, 1997.

(51) Int. Cl.[7] ..... E04C 3/02

(52) U.S. Cl. ..... 52/2.13; 52/DIG. 8

(58) Field of Search ..... 52/213, 2.11, 2.15, 52/2.21, 2.18, DIG. 8, 309.16

(56) References Cited

U.S. PATENT DOCUMENTS

| | | | |
|---|---|---|---|
| 3,580,289 | | 5/1971 | James et al. . |
| 3,586,058 | | 6/1971 | Ahrens et al. . |
| 3,765,557 | | 10/1973 | Giwer . |
| 3,886,980 | | 6/1975 | Elson . |
| 4,380,252 | | 4/1983 | Gray et al. . |
| 4,494,436 | | 1/1985 | Kruesi . |
| 4,519,290 | | 5/1985 | Inman et al. . |
| 4,846,908 | | 7/1989 | Aldrich et al. . |
| 5,259,901 | | 11/1993 | Davis et al. . |
| 5,417,138 | | 5/1995 | Morris, Jr. et al. . |
| 5,421,128 | | 6/1995 | Sharpless et al. . |
| 5,443,499 | | 8/1995 | Schmitt . |
| 5,579,609 | * | 12/1996 | Sallee ..... 52/2.13 |
| 5,735,083 | * | 4/1998 | Brown et al. ..... 52/2.13 |

FOREIGN PATENT DOCUMENTS

| | | | |
|---|---|---|---|
| 89066 | * | 4/1957 | (NO) ..... 52/2.15 |

* cited by examiner

*Primary Examiner*—Richard Chilcot
(74) *Attorney, Agent, or Firm*—Darby & Darby

(57) ABSTRACT

A method of producing an air beam having at least one curved portion, including braiding a sleeve having substantially regularly spaced axial fibers along the circumference thereof, taking-up the braided sleeve using at least one non-cylindrical take-up member, and inserting a gas-barrier tube into the sleeve.

13 Claims, 1 Drawing Sheet

CURVED AIR BEAM

This application claims priority from U.S. Provisional Application Ser. No. 60/066,381 filed Nov. 21, 1997.

FIELD OF THE INVENTION

The present invention relates to braiding techniques in general and, more particularly, to an inflatable, pre-shaped, braided structure with high fabric integrity.

BACKGROUND OF THE INVENTION

An inflatable tubular beam, also known as an air beam, is a structural support element having a pre-shaped structure, e.g., a cylindrical tube, of flexible material which is inflated to develop its rigidity. Air beams are particularly useful in situations where light weight and/or compact storage capability of the uninflated element are desired.

Inflated air beams can take various shapes and forms. Arched air beams are used, inter alia, in rapidly deployable shelters. Due to the light weight and compactness of the inflatable beams, such shelters are more conveniently transported, more quickly erected, and require less labor than conventional rigid structures.

Inflated, arched, or curved beams are also used for spars in deployable, arched, wings, such as parafoils and paragliders. The advantages of using a plurality of internally-pressurized partial-structures to support the wing, compared to ram-air inflation of the entire wing, are increased performance and improved safety.

It is known in the prior art to produce an inflatable curved or arched tubular beam or air beam by providing a gas-impermeable elastomeric or polymer film tubular lining or air bladder inside a fiber reinforced outer sleeving, such as a braided sleeve. For this purpose, it has been suggested to produce the sleeve by braiding the fibers directly onto a curved mandrel duplicating the desired shape of the final part. For each given curved or arched air beam, a customized mandrel having a specific size and shape is required.

It is also known in the art to produce a tubular air beams by braiding a fiber sleeve directly over an air bladder or elastomeric liner or tube of thin elastomeric film. To fix the braided structure to the air bladder of elastomeric liner, an adhesive may be applied to the surface of the air bladder or elastomeric liner prior to applying the braid.

To produce an air beam of sufficient strength using the methods described above, the fixed mandrel or air bladder is over-braided with a multi-layer structure, including a number of structural layers of fibers. These layers may be at least partially intertwined. In this multi-layered structure, each structural layer includes both axial and bias fibers.

U.S. Pat. No. 5,421,128, the disclosure of which is incorporated herein by reference, describes a method of producing a curved air beam by braiding a triaxial-braid sleeve over an elastomeric liner. According to the method of U.S. Pat. No. 5,421,128, the axial fibers of the triaxial braid are present only over a portion of the tube circumference, e.g., over less than 60 degrees of the 360-degree tube circumference, while the remainder of the circumference includes only non-axial bias fibers. In this configuration, a portion of the tube is constrained to be substantially inexpansible whereby, upon inflation, the tube curves with the constrained axial fiber portion defining the inside curve of the curved beam. Weak portions of the curved structure, e.g., the outside curve of the beam, may be reinforced by reinforcing means such as tape attached to the outside of the inflated tube. Instead of using an air bladder or pre-formed elastomeric lining, the braided fibers may be impregnated with an elastomeric solution that forms a gas barrier after curing. The fibers may be optionally impregnated with a solution that forms a hard outer surface after curing.

There are number of deficiencies to the air beam described in U.S. Pat. No. 5,421,128. One deficiency of this air beam is that the curvature of the beam is produced, upon inflation, by an equilibrium between constrained bias fibers (i.e., bias fibers which are constrained by axial fibers) and unconstrained bias fibers. Because of this requirement, the bias fiber orientation is dictated by the desired curvature of the beam and, therefore, the bias fiber orientation cannot be optimized based on the inflation requirements and/or the service loads for which the beam is designed. It should be noted that the optimum fiber orientation for a given beam curvature is generally different from the optimum fiber orientation for given service loads and/or inflation requirements and, therefore, additional reinforcement materials and/or processing steps are generally required to adapt the air beam for a given use.

Further, because the curvature of the air beam described in U.S. Pat. No. 5,421,128 is controlled by the location of axial fibers only on part of the beams circumference, additional materials and/or steps are required to provide a desired reinforcement of the non axially-reinforced portion.

SUMMARY OF THE INVENTION

It is an object of the present invention to provide an inflatable braided structure of a predefined shape, particularly a curved braided air beam of high fabric integrity. It is also an object of the present invention to provide a method of producing inflatable braided structures.

In contrast to prior art curved air beams, the curved air beam of the present invention may include axial fibers along the entire circumference of the beam. This provides integral (i.e., built in) axial reinforcement along the entire circumference of the braided sleeve, e.g., both on the inside and outside of the curved structure, thereby providing a stronger inflated structure. Further, since the braid curvature is a function of the axial yarns positioned around the entire circumference of the braid, the bias yarn orientation can be optimized for given inflation requirements and/or service loads.

The air beam according to the present invention has higher stiffness per unit of internal pressure, and is stronger per unit weight, compared to prior art curved air beams. Thus, the braided air beam of the present invention may include only a single structural layer of fibers, i.e., a "two dimensional" braid structure including both axial and bias fibers.

Accordance to the present invention, a braided sleeve for a curved air beam is produced by braiding apparatus including a take-up device having at least one non-cylindrical take-up member, e.g., a plurality of conical or frustoconical capstan rollers. The braided sleeve is mounted over an air bladder or elastomeric liner, or treated to form an air barrier, to produce an inflatable, curved, air beam. The radius of curvature of the curved air-beam of the present invention may be controlled, during the production process, e.g., by controlling the angle of a take-up mandrel of a take-up device, such as a conical take-up mandrel, and/or by controlling the dimensions of a portion of the take-up device mandrel used during take-up.

BRIEF DESCRIPTION OF THE DRAWINGS

The present invention will be better understood from the following detailed description of a preferred embodiment of the invention taken in conjunction with the following drawings in which.

DETAILED DESCRIPTION OF A PREFERRED EMBODIMENT

Figure 1:
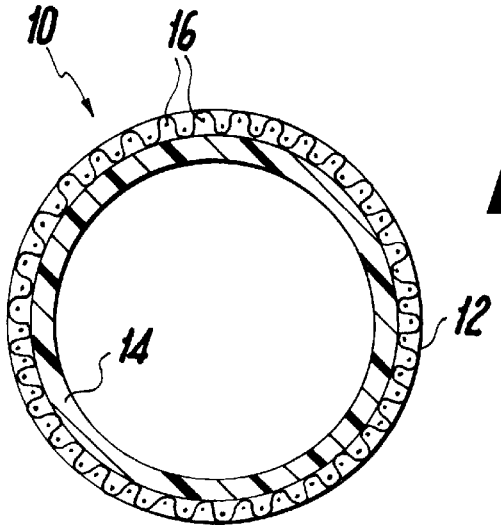
FIG. 1 is a schematic, cross-sectional, illustration of an air beam in accordance with an embodiment of the present invention.

Reference is now made to FIG. 1 which schematically illustrates a cross-sectional view of an air beam 10 having a braided sleeve 12, e.g. a triaxial braided sleeve, surrounding an air bladder 14. Braided sleeve 12 includes axial fibers 16 (also referred to as "axials 16"), which are preferably equally or regularly spaced along the circumference of sleeve 12, and bias fibers as are known in the art. Such triaxial braided sleeves, having equally or regularly spaced axials, are well-known in the art of braiding.

Air bladder 14 may be replaced by a pre-formed elastomeric liner, or the braid fibers may be impregnated with an elastomeric solution that forms a gas barrier after curing, as described in U.S. Pat. No. 5,421,128, the entire disclosure of which is incorporated herein by reference. Additionally, the braid fibers may be impregnated with a solution that forms a hard outer surface after curing, as is known in the art.

A gas barrier may be provided to the air beam fabric by continuously feeding a plastic sleeve made of poly-tubing material, for example the poly-tubing material (product number 089984) available from Consolidated Plastics, Twinsburg, Ohio, into the braid while the braid is being formed. The diameter of the sleeve should be substantially the same as or slightly larger than the inflated inside diameter of the braid. Adhesive may be applied to the outer surface of the plastic sleeve, using coating processes as are known in the art, prior to insertion of the sleeve into the braid, however, this step may not be necessary. The plastic sleeve may be brought into full contact with the inner surface of the braid by maintaining a low inflation pressure air pocket in the sleeve between the source of the sleeve and nip puller which forms the braid. This technique is known in the art. Alternatively, the braid and air bladder assembly may be inflated after formation and maintained inflated until the adhesive is adequately cured.

Figure 2:
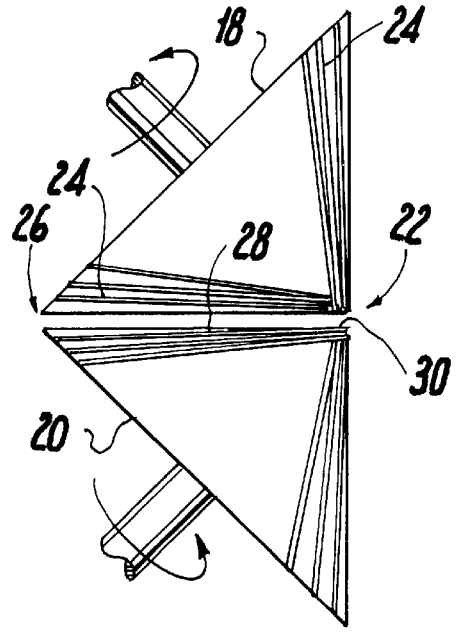
FIG. 2 is a schematic illustration of part of a take-up device including conical rollers used to form curved braided structures in accordance with an embodiment of the present invention.

Reference is now made also to FIG. 2, which schematically illustrates part of a take-up device of a braiding machine in accordance with an embodiment of the present invention. The take-up device of FIG. 2 includes a pair of conical capstan rollers, 18 and 20, which are juxtaposed at a nip (or pinch) region 22 and are configured to take-up a braided fabric sleeve 24 through a forming ring (not shown) as is known in the art. Such an arrangement is described in detail in U.S. Pat. No. 5,417,138, the entire disclosure of which is incorporated herein by reference. As described below, conical rollers 18 and 20 exert a spatially non-homogenous pulling force on the axial fibers 16 pulled through the forming ring and, thus, different fibers 16 are pulled at different speeds by the take-up device, as described below. Any type of non-cylindrical take-up rollers that produce a varying pulling force and speed can be used in conjunction with the present invention, for example, the frustoconical rollers described in U.S. Pat. No. 5,417,138.

Returning to the example of FIG. 2, nip 22 has a back end portion 26, a middle portion 28 and a front end portion 30. The axial fibers 16 that are pulled through back end portion 26, i.e., near the large diameter base of conical rollers 18 and 20, move at a higher speed than the fibers 16 that are pulled through front end portion 30, i.e., near the small diameter top of the conical rollers. Consequently, the faster-moving axial fibers 16 passing closer to back end portion 26 are longer compared to the slower-moving axial fibers 16 passing closer to front end portion 30. This results in curving of the braided sleeve, with the faster-moving, longer, axial fibers 16 on the outside of the curve and the slower-moving, shorter, axial fibers on the inside of the curved sleeve.

The principle of curving a braided structure using non-cylindrical rollers is explained in U.S. Pat. No. 5,417,135, which describes apparatus using a pair of frustoconical take-up rollers to produce a non-inflatable, curved, braided sleeve for use, e.g., in aircraft disc brakes.

In accordance with the an embodiment of the present invention, the curved braided sleeve is combined with an elastomeric lining or bladder, such as air bladder 14, to produce an inflatable curved air beam, as described below.

There are a number of alternative ways to provide varying pulling power and, thus, curving of the braided sleeve 24. For example, a series of conical rollers can be used, or a conical or frustoconical roller with an opposing rubber belt, for example, a circular or disc-shaped rubber belt, or a series of conical or frustoconical rollers with a large opposing circular or disc-shaped rubber belt, or a pair of opposing circular-shaped or disc-shaped rubber belts, or any other devices as are known in the art.

Figure 3:
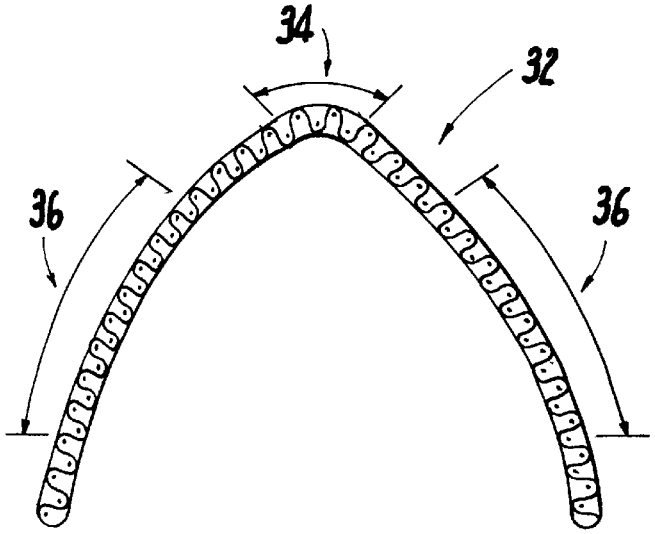
FIG. 3 is a schematic, cross-sectional, illustration of a curved air beam having a varying radius of curvature, in accordance with an embodiment of the present invention.

In an embodiment of the present invention, the curved air beam is formed with a varying radius of curvature, along the curve or along the length of the air beam. FIG. 3 schematically illustrates a curved air beam including a mid-section 34, having a relatively small radius of curvature, and two leg-sections 36 having a relatively large radius of curvature. As further shown in FIG. 3, the radius of curvature may also vary along each of sections 34 and 36. The method of the present invention enables such variation in the radius of curvature, in a curved air beam, as described below.

One way of varying the radius of curvature is by varying the slope-angle of conical rollers 18 and 20 (i.e., the angle between the conical surface and the longitudinal axis in each roller). However, this requires a different set of conical rollers to be used for each radius of curvature. Alternatively, a set of adjustable rollers may be used, wherein the slope-angle of the rollers may be adjusted "on-the-fly" during formation as the curved braid.

A preferred method of controlling the radius of curvature of the braided sleeve is by controlling the position of the incoming sleeve 24 in nip 22. For example, a smaller radius of curvature can be achieved by positioning incoming sleeve 24 to cover only a predefined section of nip 22 between middle portion 28 and front end portion 30 of nip 22. Similarly, a larger radius of curvature can be obtained by positioning the sleeve along a predefined section between back end portion 26 and middle portion 28.

Such positioning of the incoming sleeve may be accomplished in a number of ways. For example, the braiding apparatus with the forming ring fixedly attached thereto may be adjustable to different nip positions with the conical rollers being fixed. Alternatively, the conical rollers may be adjustable relative to the braiding apparatus with a fixedly attached forming ring. In a preferred embodiment, the positions of the braiding apparatus and the conical take-up rollers are both fixed and the forming ring is adjustable to move the braided sleeve in the nip to a position which yields a desired curvature. By utilizing these techniques, a single air beam can be formed with different radii of curvature at adjacent portions along its length. Further, by continuously varying the position of the take-up section, it is possible to gradually vary the radius of curvature of the sleeve along predefined regions.

A cross-section of a curved air beam 32 is shown schematically in FIG. 3. Curved air beam 32 has a mid-section 34 having a relatively small radius of curvature and two leg-sections 36, each having a relatively large radius of curvature. A curved air beam such as air beam 32 can be used, for example, as a supporting arch for a large tent. For example, such an arch having a tube-diameter of about 13 inches, a length of about 60 feet, inflated to a pressure of about 50 psi, can be used to support a tent having an interior width of about 30 feet and a height of about 24 feet.

Axial fibers 16 may include any suitable reinforcing fibers, as are known in the art, such as aramid (Kevlar), fiberglass or carbon, or synthetic fibers such as acrylic, nylon, rayon, polypropylene, ultra high molecular weight polyethylene, polyamide and/or polyester fibers. Carbon fiber can be used in application where electrical conductivity is desired. Fibers of similar or identical materials as axial fibers 16 may be used as bias fibers in the braided sleeve. The proper denier weights of the fibers are determined based upon strength requirements.

Sleeving diameters may vary from about 0.25 inch, and should be sufficiently large to enable insertion of an inflated air bladder, to about 36 inches, depending on the specific application of the air beam. For example, a sleeve diameter of 8–20 inches is suitable for various applications, such as the 13 inch diameter tent-supporting arch described above. The length of the air beam can vary from inches to kilometers, depending on the application, but is typically from a few feet to about 100 feet, for example the 60 foot long tent supporting beam described above.

The number of carriers on the braiding machine used and the number and spacing of axials is determined by the desired diameter of the sleeve, the strength requirements, the weight requirements, and similar factors, as is known in the art. For a relatively large diameter sleeve, 400–800 carrier braiders are generally adequate.

It should be appreciated that the air beam of the present invention has higher stiffness per unit of internal pressure, and is stronger per unit weight, compared to prior art curved air beams. Further, the braided air beam of the present invention may include only a single structural layer of fibers, i.e., a "two dimensional" braid structure including axial and bias fibers.

It will be appreciated by persons skilled in the art that the present invention is not limited to the specific embodiments described herein with reference to the accompanying drawing. Rather, the scope of the present invention is limited only by the following claims:

What is claimed is:

1. An inflatable tubular air beam comprising:

a braided sleeve including a single structural layer of fibers;

a first lengthwise curved portion including an inside lengthwise curve of said beam with the smallest radius of curvature and an outside lengthwise curve of said beam with the largest radius of curvature, said inside curve being about 180 degrees from said outside curve about the circumference of said beam;

a second lengthwise curved portion, said first lengthwise portion having a different radius of curvature than said second lengthwise curved portion; and at least one inside axial fiber being positioned along the circumference of said beam closer to said inside lengthwise curve than said outside lengthwise curve, at least one outside axial fiber being positioned along the circumference of said beam closer to said outside lengthwise curve than said inside lengthwise curve and said inside axial fiber being shorter in length than said outside axial fiber.

2. An air beam according to claim 1 wherein the braided sleeve comprises a triaxial braided sleeve.

3. An air beam according to claim 1 having sealed ends and an inflation valve.

4. An air beam according to claim 1 further comprising a flexible, gas-pressurizable tube within said braided sleeve.

5. An air beam according to claim 1 wherein the braided sleeve is impregnated with an elastomeric solution which is cured to form a gas barrier of the air beam.

6. An air beam according to claim 1 wherein the braided sleeve is impregnated with a solution which is cured to form a hard outer surface of the air beam.

7. An air beam according to claim 1, wherein said axial fibers extend substantially the entire length of the air beam.

8. An air beam according to claim 1, wherein said axial fibers comprise aramid fibers.

9. An air beam produced by a method comprising the steps of:

braiding a sleeve having substantially regularly spaced axial fibers along the circumference thereof;

taking-up the braided sleeve using at least one non-cylindrical take-up member, said non-cylindrical take-up member including a nip which contacts said braided sleeve; and varying the portion of said nip that said braided sleeve contacts by varying one of the slope angle of the non-cylindrical take-up member and the position of said braided sleeve on said nip in order to vary the radius of curvature of said braided sleeve.

10. An air beam produced by a method comprising the steps of:

braiding a sleeve having substantially regularly spaced axial fibers along the circumference thereof;

taking-up the braided sleeve using at least one non-cylindrical take-up member, said non-cylindrical take-up member including a nip which contacts said braided sleeve;

varying the portion of said nip that said braided sleeve contacts by varying one of the slope angle of the non-cylindrical take-up member and the position of said braided sleeve on said nip in order to vary the radius of curvature of said braided sleeve;

impregnating the sleeve with an elastomeric solution; and curing the impregnated sleeve to form a gas-barrier therein.

11. The air bag of claim 1 further comprising a plurality of inside axial fibers and a plurality of outside axial fibers wherein each of said plurality of inside axial fibers are closer to said inside curve about the circumference of said beam than said outside curve and each of said plurality of outside axial fibers are closer to said outside curve about the circumference of said beam than said inside curve, and at least one of said plurality of inside axial fibers are shorter in length than any one of said plurality of outside axial fibers.

12. The air bag of claim 9 wherein said varying the portion of said nip step occurs on-the-fly.

13. The air bag of claim 10 wherein said varying the portion of said nip step occurs on-the-fly.

US 6,182,398 B1

7 8

* * * * *